US011215155B2

(12) United States Patent
Pirkl et al.

(10) Patent No.: US 11,215,155 B2
(45) Date of Patent: Jan. 4, 2022

(54) FUEL INJECTION VALVE

(71) Applicant: Liebherr-Components Deggendorf GmbH, Deggendorf (DE)

(72) Inventors: Richard Pirkl, Regensburg (DE); Razvan-Sorin Stinghe, Hengersberg (DE); Markus Hoellbacher, Puch (AT); Alexander Preis, Regen (DE); Michael Schmid, Bischofsmais (DE)

(73) Assignee: Liebherr-Components Deggendorf GmbH, Deggendorf (DE)

( * ) Notice: Subject to any disclaimer, the term of this patent is extended or adjusted under 35 U.S.C. 154(b) by 302 days.

(21) Appl. No.: 16/492,929

(22) PCT Filed: Mar. 9, 2018

(86) PCT No.: PCT/EP2018/055975
§ 371 (c)(1),
(2) Date: Dec. 3, 2019

(87) PCT Pub. No.: WO2018/162747
PCT Pub. Date: Sep. 13, 2018

(65) Prior Publication Data

US 2020/0116113 A1 Apr. 16, 2020

(30) Foreign Application Priority Data

Mar. 10, 2017 (DE) ..... 10 2017 002 366.2

(51) Int. Cl.
*F02M 61/04* (2006.01)
*F02M 61/10* (2006.01)
(Continued)

(52) U.S. Cl.
CPC ..... *F02M 61/042* (2013.01); *F02M 61/10* (2013.01); *F02M 61/14* (2013.01);
(Continued)

(58) Field of Classification Search
CPC ..... F02M 61/042; F02M 61/10; F02M 61/14; F02M 61/1886; F02M 61/20;
(Continued)

(56) References Cited

FOREIGN PATENT DOCUMENTS

DE 60022991 T2 7/2006
DE 102012220025 A1 1/2014
(Continued)

OTHER PUBLICATIONS

ISA European Patent Office, International Search Report Issued in Application No. PCT/EP2018/055975, dated May 30, 2018, WIPO, 4 pages.

*Primary Examiner* — Hai H Huynh
(74) *Attorney, Agent, or Firm* — McCoy Russell LLP

(57) ABSTRACT

The invention relates to a fuel injection valve for the intermittent injection of fuel into the combustion chamber of an internal combustion engine having a housing which has a high pressure chamber and a low pressure chamber. In addition, the fuel injection valve has a control chamber which is divided by means of a control valve into a first and a second control chamber. The control valve in turn has a valve guide and a valve insert, wherein an outflow throttle which connects the first control chamber to the second control chamber is arranged in the valve guide. According to the invention, the connection which is formed by way of the outflow throttle between the first control chamber and the second control chamber can be interrupted temporarily in a targeted manner.

12 Claims, 4 Drawing Sheets

(51) Int. Cl.

| | |
|---|---|
| ***F02M 61/14*** | (2006.01) |
| ***F02M 61/18*** | (2006.01) |
| ***F02M 61/20*** | (2006.01) |
| ***F02M 63/00*** | (2006.01) |

(52) U.S. Cl.
CPC ..... *F02M 61/1886* (2013.01); *F02M 61/20* (2013.01); *F02M 63/0005* (2013.01)

(58) Field of Classification Search
CPC ..... F02M 63/0005; F02M 63/0054; F02M 63/0029; F02M 63/0035; F02M 47/025; F02M 2547/008
USPC ..... 123/490
See application file for complete search history.

(56) References Cited

FOREIGN PATENT DOCUMENTS

| | | | |
|---|---|---|---|
| DE | 102012221624 | A1 | 5/2014 |
| DE | 102013212490 | A1 | 12/2014 |
| EP | 2093410 | A1 | 8/2009 |
| EP | 1991773 | B1 | 5/2013 |
| WO | 2007098621 | A1 | 9/2007 |
| WO | 2014000957 | A1 | 1/2014 |
| WO | 2016041739 | A1 | 3/2016 |

FUEL INJECTION VALVE

CROSS REFERENCE TO RELATED APPLICATIONS

The present application is a U.S. National Phase of International Application No. PCT/EP2018/055975, entitled "FUEL INJECTION VALVE", and filed on Mar. 9, 2018. International Application No. PCT/EP2018/055975 claims priority to German Application No. 10 2017 002 366.2, filed on Mar. 10, 2017. The entire contents of each of the above-listed applications are hereby incorporated by reference for all purposes.

TECHNICAL FIELD

The invention relates to a fuel injection valve for intermittently injecting fuel into the combustion chamber of an internal combustion engine.

BACKGROUND AND SUMMARY

Fuel injection valves of this kind are used in fuel injection systems in which fuel is preferably directly injected into combustion chambers of self-igniting, high-speed internal combustion engines, with the injection taking place under high pressure. For this purpose, the fuel is conveyed from a fuel tank by a high-pressure fuel pump, is compressed to a high pressure and is conveyed into a rail, which acts as an accumulator for the compressed fuel. A plurality of lines that serve to supply the fuel injection valves extend out of said high-pressure fuel accumulator.

The fuel injection valves that are currently used operate on a servo-hydraulic principle, i.e. they contain an injector needle that is arranged so as to be longitudinally movable in the high-pressure chamber of the fuel injection valve and opens or closes one or more injection openings by means of its longitudinal movement. The movement of the injector needle, and thus the start and end of each injection, are hydraulically controlled in this case. A control chamber filled with fuel is provided for this purpose. The high-pressure fuel exerts pressure on the injector needle and pushes said needle against a needle seat by means of the hydraulic closing force thus provided, the pressure additionally being provided here by a needle-closing spring, which does exert a pressure on the injector needle, even if no hydraulic pressure is provided. By means of a control valve, the pressure exerted on the upper face of the injector needle can be reduced such that said injector needle is raised from the needle seat into its opening position and thus opens the injection opening again.

Corresponding control valves and control devices are used in known fuel injection valves in order to open and close the injection valve hydraulically by means of the injector needle with the required force when an electrical actuator is actuated, for example a piezoelectric element or a solenoid. The following embodiments are generally known in this case.

In a 2/2 way control device, the electrical actuator releases a discharge throttle via a pilot valve. The pressure reduction in the control chamber causes the injector needle to open. When the pilot valve is closed, the control chamber is filled via an inlet throttle and the injector needle closes again.

In a 3/2 way control device, an electrical actuator likewise releases a discharge throttle via a pilot valve. The pressure reduction in the control chamber opens the injector needle. When closing the pilot valve and the control apparatus via the inlet throttle, another fuel duct that fills the control chamber more rapidly is activated, however.

A generic fuel injection valve is known from EP 1991773 B1. A 3/2 way control device is implemented here. The known control device is formed in multiple parts and comprises a control valve having a valve insert guided in a valve guide. A discharge throttle that permanently interconnects the regions of the control chamber divided by the control valve is arranged in the valve insert. In this configuration, fuel can be permanently exchanged between the two regions of the control chamber divided by the control valve via the discharge throttle.

The problem addressed by the invention is to develop a generic fuel injection valve such that the hydraulic efficiency of the intermittent injection of the fuel into the combustion chamber is improved, and such that the injector needle can be opened and closed more rapidly than in the prior art.

According to the invention, this problem is solved by the combination of features in claim 1. Accordingly, a fuel injection valve for intermittently injecting fuel into the combustion chamber of an internal combustion engine is proposed, comprising a housing which comprises a high-pressure chamber, which is connected to a high-pressure inlet for fuel, and a low-pressure chamber, further comprising an injector needle that is longitudinally movable in the high-pressure chamber, interacts with a needle seat, and opens and closes a connection of the high-pressure chamber to an injection opening by the longitudinal movement thereof, the injector needle being urged by a compression spring with a closing force directed towards the needle seat, and the compression spring being supported at one side on a spring sleeve in which the injector needle is guided by its free end, further comprising a control chamber that is delimited by the spring sleeve and the upper end of the injector needle, and can be filled with pressurized fuel and thus exerts a closing pressure on the injector needle in a controlled manner, further comprising a control valve that is arranged in the control chamber and divides the control chamber into a first and a second control chamber, the control valve consisting of a valve insert guided in a valve guide and a discharge throttle being arranged in the valve guide, which throttle is connected to the first control chamber on one side and to the second control chamber on the other side, wherein the connection formed by the discharge throttle between the first control chamber and the second control chamber can be temporarily interrupted in a targeted manner.

Preferred embodiments of the solution according to the invention are found in the dependent claims, which are dependent on the main claim.

Accordingly, the connection formed by the discharge throttle can be interrupted by closing the discharge throttle by means of a switching element.

According to a particularly preferred embodiment of the invention, the switching element consists of a ball arranged in the discharge throttle. The ball may advantageously consist of steel or ceramic.

According to another alternative advantageous embodiment of the invention, the switching element may, however, also be a slider with a cone, a cylinder, or a plate.

In order to improve the switching mechanism, the respectively provided switching element may be retained in a sealing seat provided in the discharge throttle by a pretensioned spring. As a result, the desired switching characteristics can be produced particularly well.

According to another advantageous embodiment of the invention, the second control chamber may be delimited in part by a seat plate that is connected to the low-pressure chamber via a throttle hole that can be closed in a controlled manner. The throttle hole may be closed by means of an armature arranged in the low-pressure chamber, it being possible to raise the armature from the throttle hole in a controlled manner counter to the pre-tension of the spring by means of an electrical actuator. This armature constitutes the pilot valve, which, when actuated, activates the fuel injection valve.

According to a particularly advantageous embodiment, the valve insert may be mushroom-shaped.

The valve guide further advantageously comprises an inlet throttle that supplies high-pressure fuel into the second control chamber.

Furthermore, the valve guide may comprise at least one diagonally arranged hole via which the first control chamber can be connected to the high-pressure chamber in order to supply high-pressure fuel. Particularly advantageously, two holes that are arranged diagonally or three holes that are offset by 120° are provided.

The valve guide and the valve insert may advantageously be longitudinally movably guided in the spring sleeve. This provides a particularly compact construction.

The operating principle of the fuel injection valve according to the invention is as follows:

In the initial state, with the pilot valve closed, i.e. with the throttle hole closed and the discharge throttle simultaneously blocked in the stationary state, all the pressure chambers have an equalized pressure level which corresponds to the system pressure. The advantageously mushroom-shaped valve insert is in its lower stop position, such that the two-part control chamber is connected to the high-pressure chamber by the open control valve. The switching element, which is preferably designed as a ball, closes the connection formed by the discharge throttle between the first control chamber and the second control chamber either by its own gravity or in an accordingly spring-assisted manner in the configuration with the compression spring.

The pilot valve then opens, i.e. the armature is raised from the throttle hole, and therefore the pressure level in the second control chamber initially drops due to the fuel flowing out via the throttle hole. Although fuel flows in via the inlet throttle, a pressure drop in the second control chamber cannot be avoided. The resulting pressure gradient from the first to the second control chamber leads to the valve insert then being moved into its upper stop position, thus closing the inlet from the high-pressure chamber. Owing to the connection between the first and second control chamber formed by the discharge throttle being interrupted at the same time, this process runs at an accelerated rate, since the pressure is first reduced in the second control chamber. Then, however, the switching element, i.e. the ball, for example, is also moved out of its closing position on the cone seat and fuel flows continuously out of the first control chamber via the second control chamber. The drop in pressure in the first control chamber reduces the closing force of the injector needle on the needle seat until the fuel infiltrates on the needle seat surface, such that the injector needle opens. The injector needle then carries out its opening stroke, which is maintained by the pressure difference between the high-pressure chamber and the control chamber. The injector needle would only carry out an opening stroke until it is in contact with the upper needle stop on the valve insert. This stop point is, however, designed such that it is never reached in normal engine operation, and thus is also irrelevant.

The pilot closes, i.e. the armature closes the throttle opening. The continuous flow of fuel from the high-pressure chamber via the inlet throttle ensures the rise in pressure in the second control chamber. Immediately after the rise in pressure, the reverse pressure gradient takes effect, which then sets in from the second control chamber to the first control chamber in the form of a closing force on the switching element provided according to the invention, which is preferably designed as a ball, such that the discharge throttle between the first control chamber and the second control chamber is interrupted or blocked. The closure of the discharge throttle encourages the pressure to rise more rapidly in the second control chamber, such that the valve insert comprising the switching valve seat opens earlier and a large cross section is opened for the fuel to flow in from the high-pressure chamber. The pressure in the first control chamber then rises rapidly up to the system pressure level, and this reduces the resulting opening force on the injector needle to zero. The rapid closing process of the injector needle is then carried out by the spring force of the needle alone. The needle seat seals up and the injection is stopped.

By temporarily interrupting the connection between the first control chamber and the second control chamber by means of the discharge throttle, as provided according to the invention, the switching times can be shortened, and this results in improved overall operation and in particular in an improvement in the hydraulic efficiency. The injection process starts and ends earlier. As a result, in the event of multiple injections, the interval between the two injections can be reduced.

Further advantages of the solution according to the invention consist in that rapid opening of the injector needle ensures that the injection jet is formed earlier, and this results in improved combustion in the combustion chamber. The more rapid opening of the injector needle can be utilized to provide shorter injection intervals for multiple injections.

The more rapid closing of the injector needle can likewise be utilized to provide shorter injection intervals for multiple injections. The discharge throttle and inlet throttle can be designed for smaller volume flow rates. This in turn reduces the fuel discharge during injection via the discharge throttle, such that the hydraulic efficiency of the entire common rail system is improved. Greater hydraulic efficiency also reduces the fuel consumption of an internal combustion engine.

BRIEF DESCRIPTION OF THE FIGURES

Other features, details and advantages of the invention are explained in greater detail with reference to an embodiment shown in the drawings, in which.

DETAILED DESCRIPTION

Figure 1:
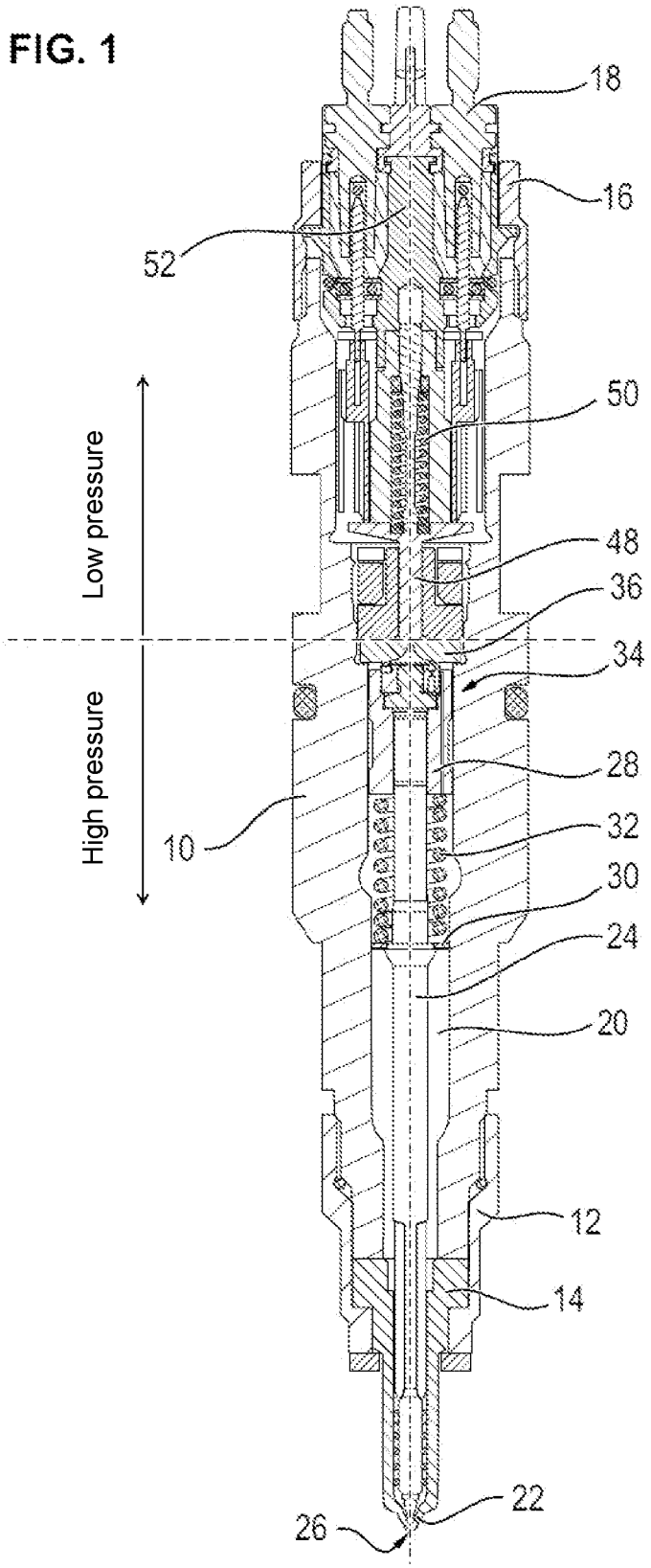
FIG. 1: is a longitudinal section through a fuel injection valve according to the invention.

FIG. 1 is a schematic longitudinal section through a fuel injection valve according to the invention. The fuel injection valve comprises a housing 10 which is connected to an injector nozzle 14 by a nozzle clamping nut 12. On the opposite side, the housing 10 is connected to an electrical wedge connector 18 by means of a closure cap 16. A high-pressure chamber 20 is formed in the interior of the housing 10.

As shown in FIG. 1, the fuel injection valve is divided into a high-pressure region and a low-pressure region. The high-pressure region 20 is delimited by a needle seat 22 at its combustion-chamber-side end. An injector needle 24 is longitudinally movably arranged in the high-pressure region 20. Said needle interacts with the needle seat 22 to open and close at least one injection opening 26, which is formed in the injector nozzle 14 so as to face the combustion chamber. The injector needle 24 is guided in a spring sleeve 28 at its end remote from the needle seat, with a compression spring 32 being arranged under pre-tension between the spring sleeve 28 and a washer 30 placed on a shoulder of the injector needle. On one side, said compression spring presses the injector needle 24 against the needle seat 22. On the other side, it presses the spring sleeve 28 against a control valve 34. The multi-part control valve 34 is supported on a seat plate 36.

The high-pressure chamber 20 can be filled with fuel under high pressure via a high-pressure connection 25 (not shown in greater detail here), which fuel has been compressed by a high-pressure pump (not shown in the drawings). Said high fuel pressure prevails in the entire high-pressure chamber 20 and brings about a hydraulic force on the injector needle 24 which easily exceeds the force of the closing spring 32. In order to generate a counter-force required for the longitudinal movement of the injector needle 24, the injector needle delimits a first control chamber 38 by means of its end face facing away from the needle seat, which control chamber is laterally delimited by the spring sleeve 28 (cf. FIG. 3). The side of the first control chamber 38 opposite the injector needle 24 is delimited by the two-part control valve 34. Said control valve 34 consists of a mushroom-shaped valve insert 40 and an annular valve guide 42. Both the valve insert 40 and the valve guide 42 are arranged in the spring sleeve 28, as is clear from FIG. 3*a*. The valve insert 40 is longitudinally movably guided in the valve guide 42. The valve guide 42 rests on the seat plate 36 and surrounds a second control chamber 44 together with the valve insert 40 and the valve guide 42. Said second control chamber 44 opens into a throttle hole 46, which can be closed in a controlled manner by an armature 48 (cf. FIGS. 3*a, b* and *c*). The armature is located on the low-pressure side of the fuel injection valve, as can be seen in FIG. 1. Fuel exiting the throttle hole 46 is discharged from the housing 10 in the low-pressure region via a leak-off connection (also not shown here).

The armature 48 is urged towards the throttle hole 46 by a spring 50. In the inactive state, the armature 48 tightly closes the throttle hole on account of the spring force of the compression spring 50. The armature 48 can be raised from the throttle hole 46 by an electromagnet counter to the spring force of the compression spring 50.

As stated above, the control valve 34 is designed in two parts in the embodiment shown here. It consists of the mushroom-shaped valve insert 40, which comprises a hole 54, as shown in FIG. 3.

The valve guide, in which the valve insert is longitudinally movably guided, comprises an inlet throttle 56 and a discharge throttle 58. The inlet throttle connects the high-pressure chamber 20 to the second control chamber 44. The discharge throttle 58 connects the first control chamber 38 to the second control chamber 44. The discharge throttle 58 can be closed by a ball 60 (cf. in particular FIGS. 2 and 3). According to the view in FIG. 3*c*, the valve guide 42 also comprises two diametrically opposite, diagonally arranged holes 62, through which fuel can flow.

The operation of the fuel injection valve according to the invention is as follows: In the de-energized state of the electromagnet 52, the armature 48 closes the throttle hole 46 in the seat plate 36 and prevents the fuel from flowing out of the second control chamber 44 into the leakage region, i.e. the region in the low-pressure part of the fuel injection valve. Furthermore, the seat plate 36 is pressed against the housing 10 (cf. FIG. 1). Owing to the high surface quality and smoothness of the contact surface, radial sealing is thus ensured between the high-pressure and low-pressure region (leakage region), as well as between the high-pressure region and the second control chamber 44. This prevents permanent leakage.

Once the electromagnet 52 is energized, the armature 48 is raised from the throttle hole 46, such that fuel flows out of the second control chamber 44 into the low-pressure region through the throttle hole 46 in the seat plate 36 and thus produces a drop in pressure in the second control chamber 44. The drop in pressure results in a pressure difference between the control chamber 44 and the first control chamber 38.

Figure 3A:
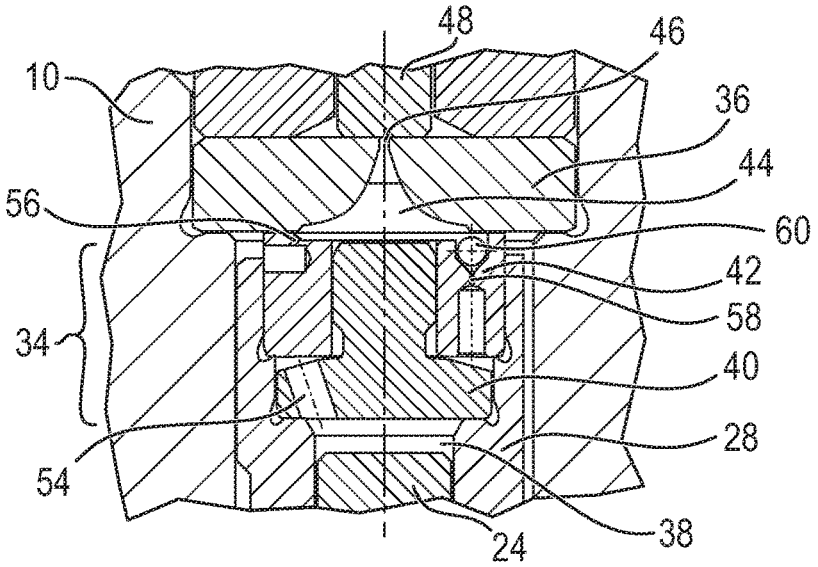
Figure 3B:
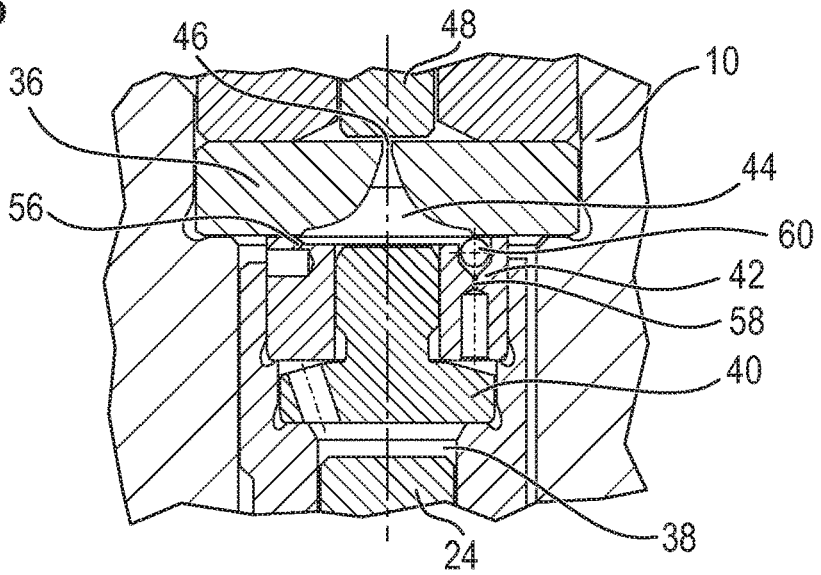

This pressure difference ensures that the valve insert 40 and the ball 60 are pushed upwards and fuel flows out of the first control chamber into the second control chamber through the discharge throttle 58 in the valve guide 42, as a result of which pressure equalization is established between the two control chambers 38, 44 (cf. FIG. 3*a*). The resulting drop in pressure in the first control chamber 38 in comparison with the high-pressure region leads to the injector needle 24 being raised, as a result of which the injection opening 26 of the injector nozzle 14 is opened and the injector carries out injection into the combustion chamber (not shown here).

Once the electromagnet 52 is no longer energized, the armature 48 closes the throttle hole 46 in the seat plate 36 and the ball 60 is pressed back into a valve seat (not shown here) of the valve guide in order to close the discharge throttle 58.

As a result, the first control chamber 38 is immediately separated from the second control chamber 44. The pressure difference between the first and the second control chamber develops due to the fuel flowing in from the high-pressure region via the inlet throttle 56 of the valve guide 42, without additional losses due to the fuel flowing away into the first control chamber 38 (cf. FIG. 3*b*).

Figure 3C:
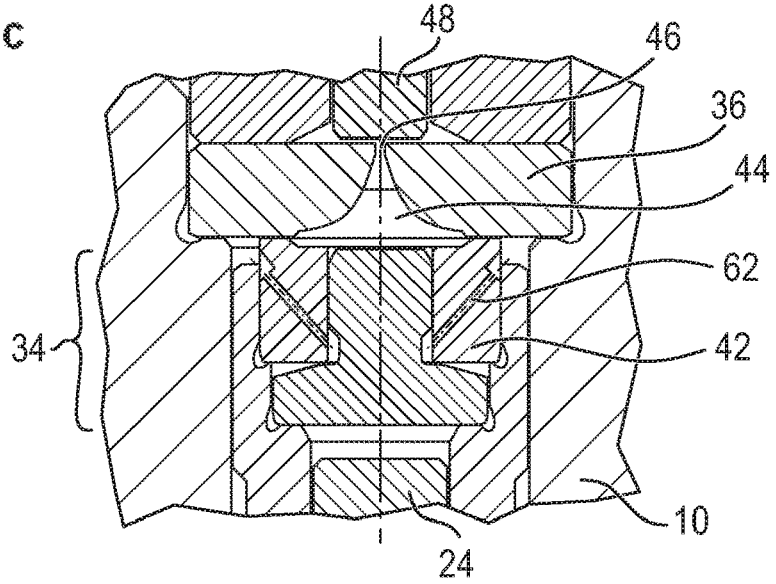
Figure 4:
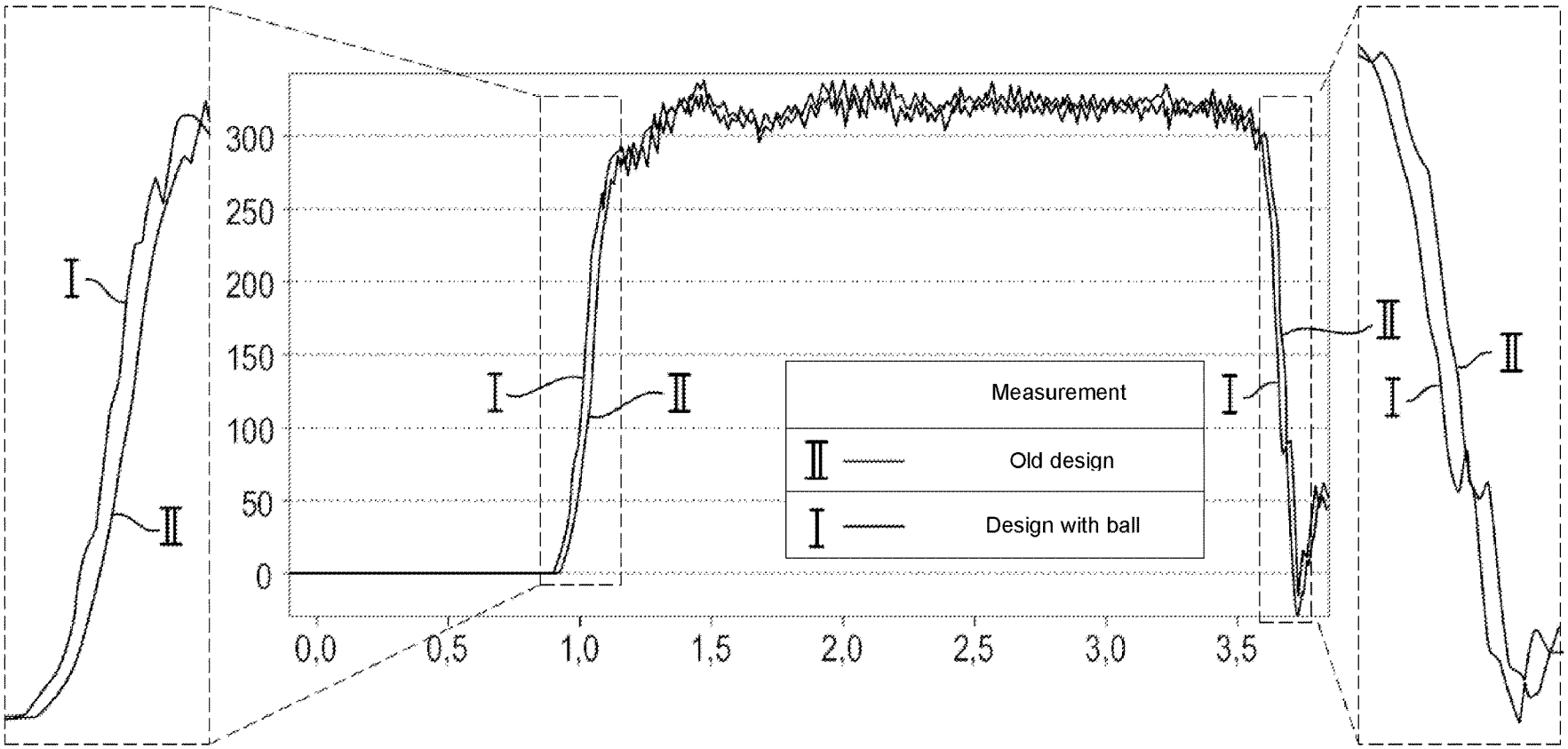
FIG. 4: shows the time curve for the injection rate using an injection valve according to the invention in comparison with a conventional injection valve.

In comparison with the conventional three-way valve, which has a constant connection between the first and second control chamber, in this control valve 34 according to the invention, the valve insert 40 is pressed downwards earlier against the spring sleeve 28 due to pressure building up more rapidly in the second control chamber 44. In the process, the inlet holes 62 in the valve guide 42 are opened and the first control chamber 38 is suddenly filled with fuel from the high-pressure region (FIG. 3*c*). As a result, the same pressure level as in the high-pressure region 20 develops in the second control chamber 44 as well as in the first control chamber 38. The injector needle 24 is pressed back into the needle seat 22 by the pressure applied in the first control chamber 38, additionally assisted by the force of the compression spring 32, and therefore the injection into the combustion chamber (not shown here) stops.

Figure 2A:
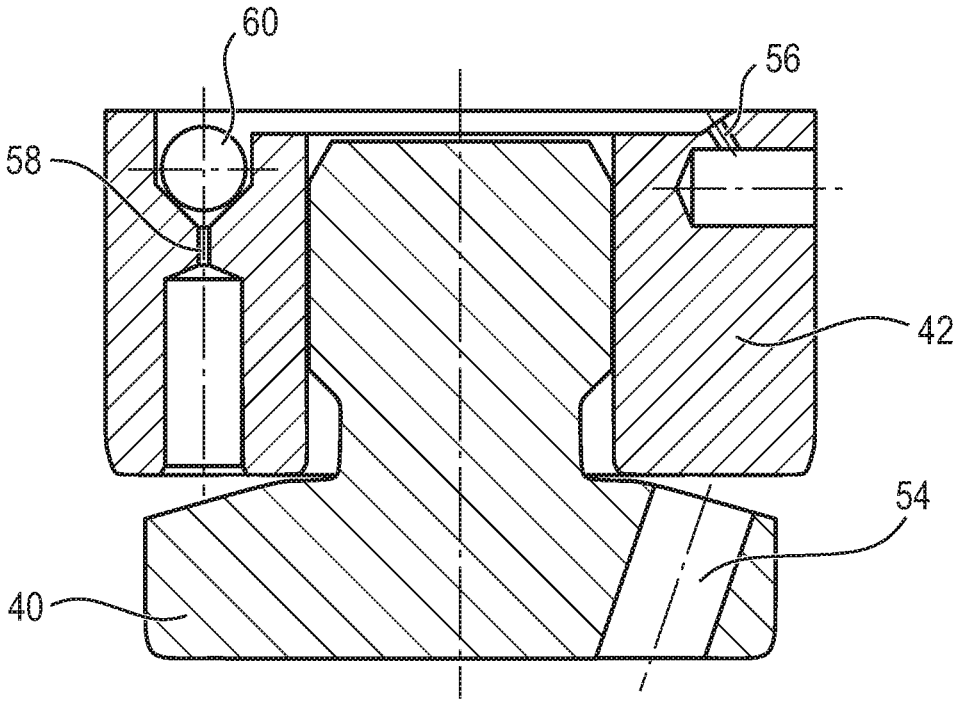
FIG. 2*a* and FIG. 2*b*: are detailed views of the fuel injection valve according to a detail from FIG. 1, FIG. 3*a*, FIG. 3*b*, and FIG. 3*c*: are further detailed views according to the longitudinal section through the fuel injection valve according to FIG. 1 in different operating positions.
Figure 2B:
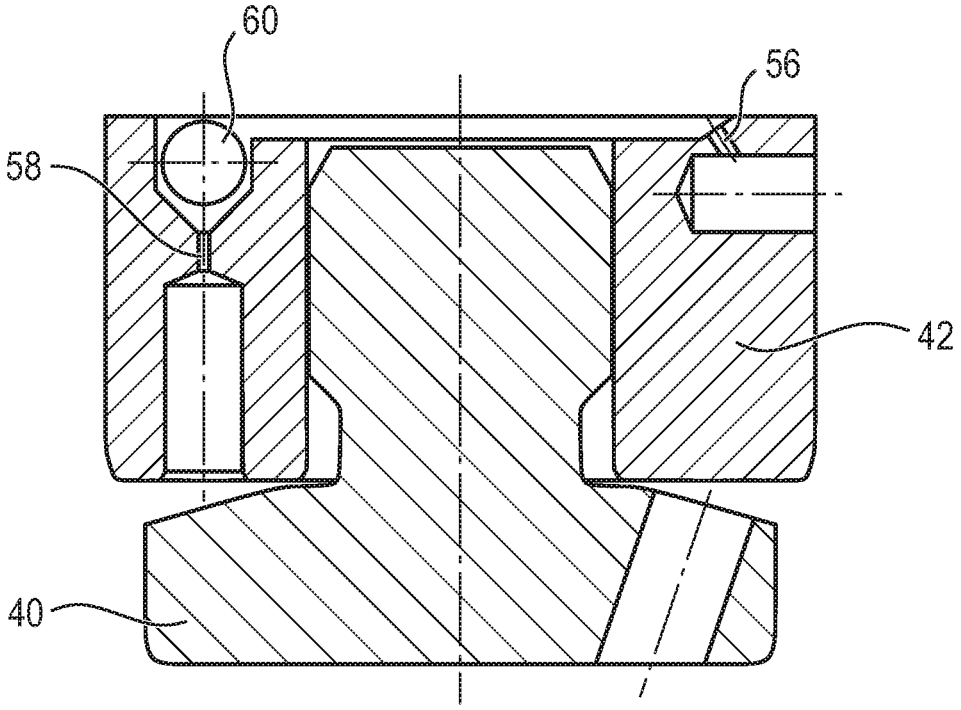

FIG. 2*a* clearly shows the closed position of the ball 60 in which the discharge throttle 35 is closed. In the embodiment shown here, the ball 60 closes due to gravity. In an alternative embodiment (not shown here), the ball can additionally also be supported by a spring (not shown in greater detail). The view according to FIG. 2*b* shows the ball 60 in a raised position. Here, owing to the pressure gradient, the ball 60 is moved away from the discharge throttle 58, such that discharge throttle 58 is opened.

In FIG. 5, the time curve for the injection rate according to the invention (curve I) is compared with the time curve for the injection rate according to the prior art (curve II). The difference is that, according to the prior art, the discharge throttle 58 cannot be closed by a ball 60, and therefore fuel can flow through the discharge throttle in every state. The rising flank and the falling flank are shown so as to be enlarged in the left-hand region of the graph and the right-hand region of the graph, respectively, in order to demonstrate the differences between the curves more clearly. It is clear here that the start and end of the injection in the embodiment from the present invention (curve I) is a few microseconds earlier than in the prior art (curve II). As already explained above, this has significant advantages, in particular for multiple injections. As a result, a plurality of injections can be carried out closer together. Short injection intervals also have significant advantages in terms of reducing emissions from internal combustion engines, since this allows for more uniform combustion in the combustion chamber.

The invention claimed is:

1. A fuel injection valve for intermittently injecting fuel into the combustion chamber of an internal combustion engine, comprising:

a housing which comprises a high-pressure chamber, which is connected to a high-pressure inlet for fuel, and a low-pressure chamber, an injector needle that is longitudinally movable in the high-pressure chamber, interacts with a needle seat, and opens and closes a connection of the high-pressure chamber to an injection opening by the longitudinal movement thereof, the injector needle being urged by a compression spring with a closing force directed towards the needle seat, and the compression spring being supported at one side on a spring sleeve in which the injector needle is guided by a free end of the injector needle, a control chamber that is delimited by the spring sleeve and the upper end of the injector needle, and is fillable with pressurized fuel and thus exerts a closing pressure on the injector needle in a controlled manner, a control valve that is arranged in the control chamber and divides the control chamber into a first and a second control chamber, the control valve consisting of a valve insert guided in a valve guide and a discharge throttle being arranged in the valve guide, which throttle is connected to the first control chamber on one side and to the second control chamber on the other side, wherein the connection formed by the discharge throttle between the first control chamber and the second control chamber is temporarily interruptible in a targeted manner.

2. The fuel injection valve according to claim 1, wherein the connection formed by the discharge throttle is interrupted by closing the discharge throttle by means of a switching element.

3. The fuel injection valve according to claim 2, wherein the switching element is a ball arranged in the discharge throttle.

4. The fuel injection valve according to claim 3, wherein the ball consists of steel or ceramic.

5. The fuel injection valve according to claim 2, wherein the switching element is a slider with a cone, a cylinder, or a plate.

6. The fuel injection valve according to any of claim 2 wherein the switching element is retained in a sealing seat provided in the discharge throttle by a pre-tensioned spring.

7. The fuel injection valve according to claim 1, wherein the second control chamber is delimited in part by a seat plate that is connected to the low-pressure chamber via a throttle hole that is closable in a controlled manner.

8. The fuel injection valve according to claim 7, wherein the throttle hole is closable by means of an armature arranged in the low-pressure chamber, the armature controllable to be raised from the throttle hole counter to the pre-tension of a spring by means of an electrical actuator.

9. The fuel injection valve according to claim 1, wherein the valve insert is mushroom-shaped.

10. The fuel injection valve according to claim 1, wherein the valve guide comprises an inlet throttle for supplying high-pressure fuel into the second control chamber.

11. The fuel injection valve according to claim 1, wherein the valve guide comprises at least one diagonally arranged hole via which the first control chamber is connectible to the high-pressure chamber in order to supply high-pressure fuel.

12. The fuel injection valve according to claim 1, wherein the valve guide and the valve insert are longitudinally movably guided in the spring sleeve.

* * * * *